US005364141A

United States Patent [19]

King

[11] Patent Number: 5,364,141

[45] Date of Patent: Nov. 15, 1994

[54] TAMPER-PROOF SECURITY SEAL

[76] Inventor: F. Wayne King, 3420 NW. 71st St., Gainesville, Fla. 32606

[21] Appl. No.: 207,819

[22] Filed: Mar. 8, 1994

Related U.S. Application Data

[63] Continuation of Ser. No. 11,048, Jan. 29, 1993, abandoned.

[51] Int. Cl.[5] ..... B65D 55/06

[52] U.S. Cl. ..... 292/318; 292/322

[58] Field of Search ..... 292/307 R, 307 A, 317, 292/318, 319, 320, 321, 322, 323, 325, 328; 24/16 PB

[56] References Cited

U.S. PATENT DOCUMENTS

| | | | |
|---|---|---|---|
| 3,466,077 | 9/1969 | Moberg . | |
| 3,556,575 | 1/1971 | Farba | 292/318 X |
| 3,605,199 | 9/1971 | Eberhardt . | |
| 3,718,355 | 2/1973 | Carter | 292/321 |
| 3,735,449 | 5/1973 | Rosales . | |
| 3,830,538 | 8/1974 | Moberg | 292/322 |
| 3,881,759 | 5/1975 | Fuehrer | 292/321 |
| 3,973,293 | 8/1976 | Noorily | 24/16 PB |
| 4,093,288 | 6/1978 | Suzuki | 292/321 |
| 4,097,966 | 7/1978 | Lefnaer | 24/16 PB |
| 4,287,644 | 9/1981 | Durand | 292/318 X |
| 4,424,994 | 1/1984 | Dowden | 292/318 |
| 4,609,218 | 9/1986 | Chevillard et al. | 292/320 |
| 4,722,562 | 2/1988 | Burt | 292/318 |

*Primary Examiner*—Rodney M. Lindsey

*Attorney, Agent, or Firm*—Saliwanchik & Saliwanchik

[57] ABSTRACT

A novel security seal which cannot be removed without destroying or defacing the seal, thereby rendering tampering detectable. The novel seal comprises a strap having a tongue end, a locking head at the other end, with a key and stop plate disposed therebetween. To engage the seal, the tongue is looped around and inserted through the locking head. As it is pulled tight, the key engages a lock plate inside the head. When the key is fully engaged, the stop plate abuts the head, preventing undetected tampering or withdrawal of the tongue. In locked position, the tongue remains exposed and is therefore a convenient location for coded information.

4 Claims, 3 Drawing Sheets

TAMPER-PROOF SECURITY SEAL

This application is a continuation, of application Ser. No. 08/011,048, filed Jan. 29, 1993 now abandoned.

BACKGROUND OF THE INVENTION

Security seals are used to limit access to, or prevent tampering with, items that are under strict inventory control, items such as company equipment, materials being shipped in bond, or government controlled commodities. The security seals commonly used are tags or labels that lock or glue on the inventoried items in a manner that prevents the seals from being removed without leaving evidence of the post-inventory tampering in the form of damaged or destroyed seals.

Security seals are used to track wildlife hides and other wildlife products that are traded commercially under government license, regulation, quota, or export-/import permit. For example, the Convention on International Trade in Endangered Species of Wild Fauna and Flora (CITES), an international treaty with 116 signatory member nations that is administered by the United Nation Environment Programme, prohibits international trade in some wildlife commodities unless the articles are tagged with self-locking, non-reusable security seals. The security seals must be on raw (untanned) wildlife hides moving in international commerce during exportation from the country of natal origin, during transshipment through intermediate countries, and during importation into the final destination country. The seals must also remain on the hides through the tanning process and up to the point that the hides are cut into the pieces that will be used in manufacturing the retail product. Similar tagging regulations are mandated by U.S. federal and state wildlife agencies in relation to commercial trading in several North American wildlife species.

The seals usually bear a distinctive logo or emblem and a unique number or alphanumeric code. In order to track a series of inventoried items, seals may bear consecutive numbers or sequential codes. To deter alteration, the numbers or codes usually are permanently imprinted, embossed, or burned into the seal, and they may be in the form of human readable characters or electronically readable bar codes. To discourage counterfeiting, the color of the material the seal is made from, the color and design of the logo/emblem, the form of the numbering or coding, the sequence of numbers or codes, and the color of the numbering or coding (human readable or bar code) may be varied periodically.

During tanning, some types of wildlife hides are soaked sequentially in a series of extremely alkaline (pH 11.0) and strongly acidic (pH 1.0) chemical solutions. To pass unscathed through the tanning process, the seals used on wildlife hides must be inert to these corrosive chemicals.

Although a number of seals are currently used to tag CITES or U.S. government controlled raw wildlife hides, none are completely satisfactory.

The seals most widely used on wildlife hides are plastic door seals. They consist of polyethylene or nylon straps, one end (the tongue) of which loops around to lock into the other end (the lock or head). A plastic door seal is usually chemically inert, but when the seal is inserted through the hide and the ends locked together, it forms a large open loop which, during tannage, snags on other hides and on tanning equipment. When that occurs, the chemically-softened hide tears and the tag falls off. In addition, plastic door seals can be unlocked and reused, an undesirable characteristic for a security seal.

The metal loops in plastic-and-metal padlock seals are not inert to tanning chemicals, and both plastic-and-metal and all plastic padlock seals snag on other hides and on tanning equipment, tear the hide, and fall off.

Plastic pull-tight seals, such as bundle ties of the types disclosed in U.S. Pat. Nos. 3,605,199 or 3,735,449, can be removed, which allows illegal dealers to remove the tags from inventoried hides for reuse on poached hides.

Metal door seals and metal ball seals are not inert and react with the chemicals used to tan raw hides. The resulting metal salts stain the hides, and during tanning the eroded tags cut and scratch the chemically softened hides.

Lead-and-wire seals and cable seals are easily counterfeited. In addition, they are not chemically inert and fall off after being attacked by the chemicals used to tan raw hides, and the resulting metal salts stain the hides and contaminate the tanning formula.

Permanently glued polyolefin door seals are sufficiently inert to withstand most tanning chemicals, but when the hides are dyed, the tags readily accept the color, which obscures the numbers and codes.

As is made evident from the foregoing, a need exists for an inert, tamper-proof, snag-resistant seal capable of containing coded information.

BRIEF SUMMARY OF THE INVENTION

The novel plastic security seal taught herein is a strap which overcomes these problems—it is chemically inert, it is a self-locking flat strap when unlocked, it remains a flat strap when locked so as to be snag-resistant, and once locked it cannot be removed intact. The security seal is a molded plastic strap consisting of a flat tongue on one end, a locking head on the other end, and a stop plate positioned therebetween. There are teeth proximal to the stop plate, and there is a lock plate housed in the locking head. In use, the tongue is looped through a piece of equipment or commodity and then passed through the locking head until snapped tight against the stop plate. Once the head and stop plate are locked together, the strap forms a tag that cannot be removed unless either the tag, or the item to which it is attached, is cut away. In addition to human readable alphanumeric codes, a preferred embodiment of the subject invention bears machine-readable bar codes which assist in inventorying large consignments of hides.

DETAILED DESCRIPTION OF THE INVENTION

Figure 1:
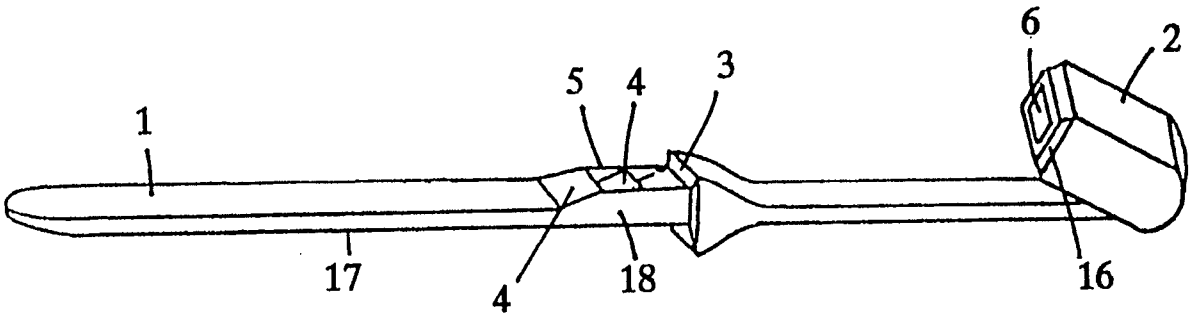
FIG. 1 is a perspective view of a tamper-proof security seal in accordance with the subject invention.
Figure 2:
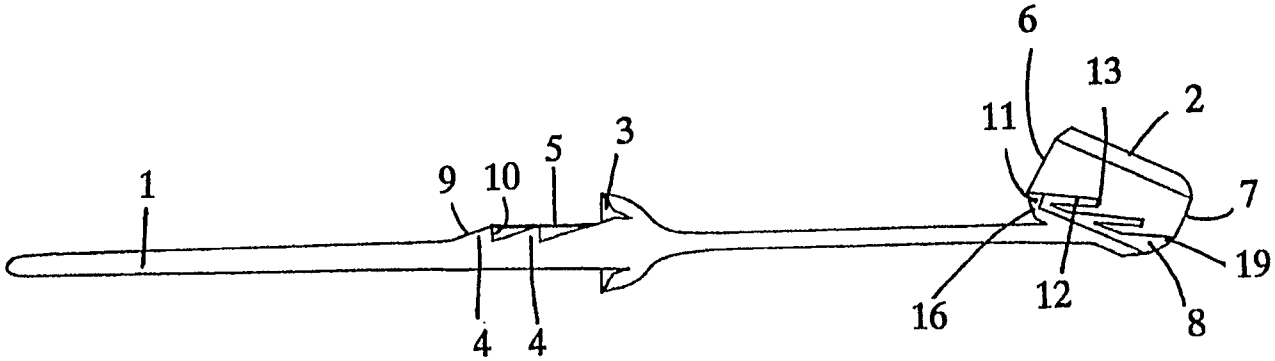
FIG. 2 depicts a longitudinal section of the embodiment depicted in FIG. 1.
Figure 3:
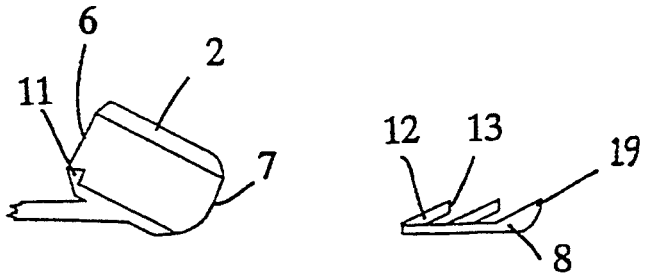
FIG. 3 is a disassembled view of the locking head portion of the longitudinal section depiction of FIG. 2.
Figure 4:
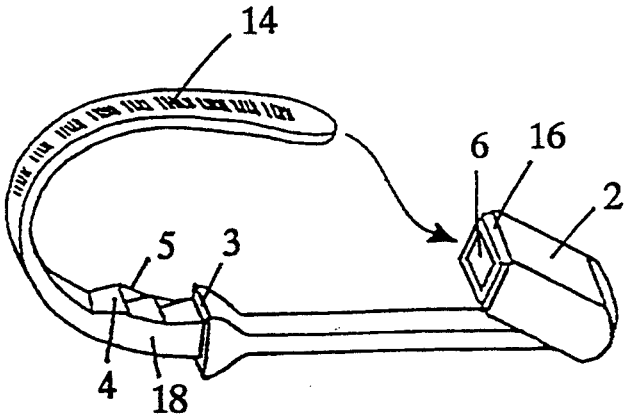
FIG. 4 is a perspective view of the embodiment depicted in FIG. 1, shown in the process of being locked.
Figure 5:
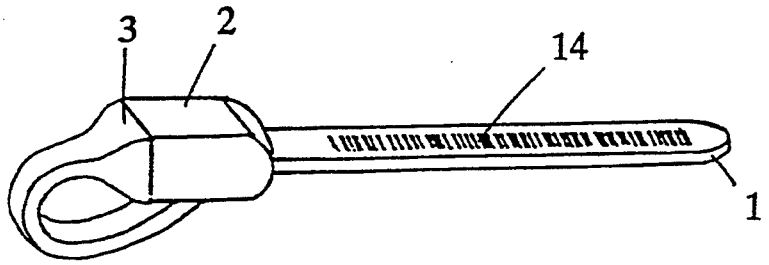
FIG. 5 is a perspective view of the embodiment depicted in FIG. 1 in a locked position.
Figure 6:
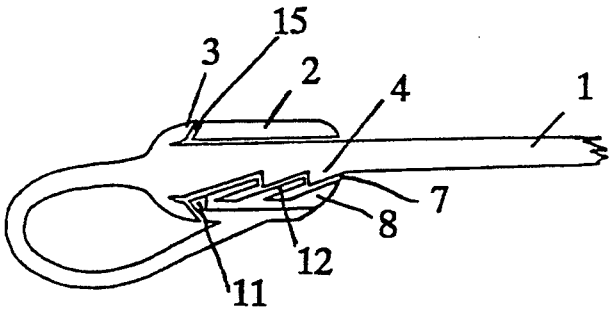
FIG. 6 is a longitudinal section of the FIG. 1 embodiment in a locked position.

Referring to FIGS. 1 and 2, the novel security seal consists of a strap 17 of resilient, shape-retaining plastic such as nylon, polyethylene, or the like, having a flat tongue 1 at one end, a locking head 2 at the other end, and a stop plate 3 disposed therebetween. Locking head 2 is formed with an aperture therethrough such that locking head 2 has a tongue-receiving orifice 6 and an exit opening 7, as well as a top wall, a bottom wall, and a pair of side walls. The ends 16 of the locking head walls which define tongue-receiving orifice 6 slope away from the external surfaces of said walls toward an imaginary point tongue-ward of head 2 on the longitudinal axis passing through the locking head aperture such that when the seal is locked, ends 16 slope inward toward stop plate 3. In a preferred embodiment, stop plate 3 is configured in a complementary fashion such that when the security seal is in its locked position as depicted in FIGS. 5 and 6, stop plate 3 securely abuts ends 16 of locking head 2, thereby defining sloped slot 15. On the internal surface of the bottom wall of locking head 2 extending upward partially into the locking head aperture adjacent to tongue-receiving orifice 6 is stop lip 11. Lock plate 8 abuts stop lip 11 such that stop lip 11 prevents lock plate 8 from being pulled through orifice 6 once the seal has been placed in locked position. In a preferred embodiment, strap 17 is integrally connected to the bottom wall of locking head 2.

The security seal has a locking mechanism which, once engaged, prevents undetected disengagement of the security seal, thereby rendering it tamper-proof. The locking mechanism has major two components, key 18 molded into the tongue-end of strap 17 adjacent to stop plate 3, and lock plate 8 inside the locking head 2. Key 18 consists of a plurality of substantially rigid, acutely angled teeth 4, each having a gradually sloping surface 9 and a substantially vertical surface 10, as compared to the longitudinal axis of strap 17, oriented such that the sloping surfaces 9 face the tongue-end of strap 17, and vertical surfaces 10 face stop plate 3. Molded side panels 5 close off the lateral ends of the spaces between the key teeth 4. Lock plate 8 has a pick barrier 19 and a plurality of flexible cantilevered pawl teeth 12 oriented such that their crests 13 are pointing toward the exit opening 7 of locking head 2. The direction of the cantilevered pawl teeth 12 inside the head 2, coupled with pick barrier 19 and the relatively small exit opening 7 in the head 2 prevents the locking head 2 from being molded in one piece. As a consequence, the lock plate 8 is molded separately and then fused into the locking head 2 by means well known in the art, such that pick barrier 19 laterally spans, and thereby partially defines, exit opening 7.

In operation, when tongue 1 is passed through orifice 6, through locking head 2, out exit opening 7, and pulled tight, the gradually sloping surfaces 9 of key teeth 4 are wedged against the slope of cantilevered pawl teeth 12. As tongue 1 is pulled tighter, the cantilevered pawl teeth 12 flex downward and allow key teeth 4 to slide forward like a ratchet until the forward motion is stopped by stop 3 plate abutting ends 16 of locking head 2, at which point pawl teeth 12 have engaged key teeth 4 to prevent withdrawal of key 18 and tongue 1 from locking head 2.

Once locked, tongue 1 cannot be withdrawn from locking head 2 because vertical surfaces 10 of key teeth 4 and crests 13 of pawl teeth 12 are engaged. Attempts to pull tongue 1 out of locking head 2 are prevented by the angle of engagement of key teeth 4 and pawl teeth 12, and only pull lock plate 8 tighter into locking head 2. If lock plate 8 somehow becomes disengaged from its fused position, it cannot be removed from locking head 2 by way of the exit opening 7, because the cantilevered pawl teeth 12 are in engagement with key teeth 4, which are prevented from moving in the direction of exit opening 7 by stop plate 3, which abuts the other end 16 of locking head 2. The disengaged lock plate 8 cannot be removed from locking head 2 in the other direction by retracting key 18, because lock plate 8 abuts stop lip 11. In addition, the lock cannot be picked. To pick the lock, pawl teeth 12 of lock plate 8 would have to be depressed; however, pawl teeth 12 cannot be reached by a pick. A pick slipped into the top of the exit opening 7 encounters only the backside of tongue 1; a pick inserted into the bottom of the exit opening 7 passes over pick barrier 19 into the space under the first cantilevered pawl tooth 12 of lock plate 8; and a pick passed into the side of the exit opening 7 cannot reach pawl teeth 12 because of side panels 5 of key 18. Finally, a pick slipped into slot 15 between stop plate 3 and head 2 cannot reach the teeth because slot 15 slopes away from head 2 and into the stop plate 3.

Strap 17 is molded from polyethylene or other strong, chemically-inert plastic by means well known in the art. Information can be stored on strap 17 by means well known in the art. For example, tongue 1 of strap 17 can bear a human readable alphanumeric code and may also include a machine readable bar code 14. Logos or emblems can also be imprinted on tongue 1. A preferred code would consist of a unique number and a numeric code for year of issue, and may have additional alphabetic codes of country of origin shipper, and species of wildlife. In a preferred embodiment, strap 17 is approximately 6 inches long when open (unlocked). Alternatively, it may be shorter or longer. The exact length and width of strap 17 may vary according to the mount of information included in the codes. The color of strap 17 can be varied as needed. Skilled security seal makers and security seal users surely shall stipulate the subject security seal, a single, slim, self-locking, snag-resistant strap, snugly secured to special skins, solves snagging, scratching, shredding, and salt-staining of sequentially-soaked, softened skins, surprisingly simply, substantially superior to standard seals. While the security seal of the subject invention has been designed to fulfill certain needs peculiar to tags used on animal skins, it can be used in almost any situation where a security seal is desired.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A security seal adapted to be looped upon itself in self-locking, irreversible relation, comprising:

a strap having a tongue portion at one end and a locking head at the other with a stop plate disposed therebetween, said locking bead having an aperture therethrough such that said locking head has a tongue-receiving orifice and an exit opening through which to pass said tongue, wherein surfaces of said locking head which define said tongue-receiving orifice are sloped from external edges of said surfaces inward toward said stop plate when said stop plate is in a locked configuration, abutting the surfaces defining said tongue-receiving orifice, and wherein said stop plate has sloped surfaces which are complementary to those defining said tongue-receiving orifice such that when said stop plate is in its locked configuration, the sloped surfaces which define said tongue-receiving orifice and the complementary sloped surfaces of said stop plate together define a sloped slot which slopes away from said locking head and in towards said stop plate;

a key integrally connected to said strap adjacent to said stop plate disposed on the tongue side of said stop plate, said key comprising a plurality of key teeth longitudinally spaced relative to said strap and a pair of side panels rising vertically from said strap, enclosing the lateral ends of the spaces between said teeth, each of said teeth being defined by a gradually sloping surface and substantially vertical surface oriented such that said vertical surface faces said stop plate; and a lock plate disposed in said aperture, said lock plate comprising a plurality of cantilevered pawl teeth sloped such that the crests of said pawl teeth are oriented toward the exit opening and configured in correspondence to and for cooperative engagement with said key teeth, such that when said tongue is passed through said aperture and pulled tight, said key is pulled into said locking head whereby said pawl teeth engage said key teeth, said stop plate abuts said locking head, and the seal is thereby irreversibly locked.

2. The security seal of claim 1, further comprising a pick barrier disposed such that it laterally spans a portion of said exit opening and thereby defines a part of said exit opening.

3. The security seal of claim 1, further comprising a stop lip extending into said aperture from a wall thereof, proximal to said tongue-receiving orifice and abutting said lock plate.

4. The security seal of claim 1, further comprising coded information on said tongue.

* * * * *

UNITED STATES PATENT AND TRADEMARK OFFICE

CERTIFICATE OF CORRECTION

PATENT NO. : 5,364,141

DATED : November 15, 1994

INVENTOR(S) : F. Wayne King

It is certified that error appears in the above-indentified patent and that said Letters Patent is hereby corrected as shown below:

Column 4, line 64: Delete "locking bead" and insert --locking head--.

Column 1, line 24: Delete "United Nation" and insert --United Nations--.

Signed and Sealed this

Twenty-first Day of February, 1995

*Attest:*

Bruce Lehman

BRUCE LEHMAN

*Attesting Officer*

*Commissioner of Patents and Trademarks*